US005651221A

United States Patent [19]

Golen

[11] Patent Number: 5,651,221

[45] Date of Patent: Jul. 29, 1997

[54] INTERLOCKING STORM SHUTTER ASSEMBLY

[76] Inventor: Selig Golen, 5137 NW. 93rd Doral Way, Doral Estates, Miami, Fla. 33178

[21] Appl. No.: 488,154

[22] Filed: Jun. 7, 1995

Related U.S. Application Data

[63] Continuation of Ser. No. 155,016, Nov. 19, 1993, abandoned.

[51] Int. Cl.[6] ..... E06B 9/02

[52] U.S. Cl. ..... 52/202; 49/50; 49/464; 52/588.1; 52/630

[58] Field of Search ..... 49/50, 57, 61, 49/62, 464; 52/202, 578, 579, 588.1, 630

[56] References Cited

U.S. PATENT DOCUMENTS

| | | | |
|---|---|---|---|
| 1,078,621 | 11/1913 | House | 52/588.1 X |
| 2,867,011 | 1/1959 | Becker | 49/464 |
| 2,878,536 | 3/1959 | Becker | 49/464 X |
| 3,234,700 | 2/1966 | Creveling | 52/630 X |
| 4,333,271 | 6/1982 | DePaolo et al. | 52/202 X |
| 4,685,261 | 8/1987 | Seaquist | 52/202 |
| 4,819,398 | 4/1989 | Dameron | 52/588.1 X |
| 5,165,213 | 11/1992 | Finch et al. | 52/578 X |
| 5,345,716 | 9/1994 | Caplan | 49/61 |
| 5,383,315 | 1/1995 | Birs | 49/61 X |
| 5,426,893 | 6/1995 | Hoffman | 49/50 X |

FOREIGN PATENT DOCUMENTS

| | | | |
|---|---|---|---|
| 529025 | 4/1957 | Belgium | 52/588.1 |
| 678250 | 12/1964 | Italy | 52/588.1 |
| 850642 | 10/1960 | United Kingdom | 52/588.1 |

*Primary Examiner*—Robert Canfield
*Assistant Examiner*—Kevin D. Wilkens
*Attorney, Agent, or Firm*—Malloy & Malloy, P.A.

[57] ABSTRACT

A storm shutter assembly comprising a plurality of panels designed to be disposed in an operative position defined by overlying, covering relation to doors, windows, and like structures or openings of a building. Each panel includes an oppositely disposed longitudinal edge specifically structured, disposed and configured to provide an interlocking engagement with a correspondingly positioned longitudinal edge of a next adjacent one of the plurality of panels so as to define a substantially closed seam along a common length of the interlocked adjacent panels, wherein the closed seam is resistant to separation as well as the passage of moisture under high wind conditions therethrough.

5 Claims, 3 Drawing Sheets

INTERLOCKING STORM SHUTTER ASSEMBLY

The present application is a continuation-in-part of the patent application previously filed on Nov. 19, 1993, having Ser. No. 08/155,016, now abandoned.

BACKGROUND OF THE INVENTION

1. Field of the Invention

This invention relates to a storm shutter assembly comprising a plurality of interconnected panels which are specifically structured to have their correspondingly disposed longitudinal edges interlocked with one another to form a closed seam thereby eliminating the need for supplementary connectors, such as screws, to accomplish such fixed interconnection between adjacent panels.

2. Description of the prior Art

During harsh and/or severe weather conditions, such as a hurricane, it is common practice to use what is commonly referred to as storm shutters. These prior art storm shutters are formed from a metallic or other high strength, substantially lightweight material, other than wood. A plurality of these panels collectively cover the various openings of a building such as a door opening, window, etc. and such panels are interconnected to one another to cover the spans of the door or window opening. Interconnection of the panels usually occurs along an overlapping longitudinal edge and further auxiliary connectors such as screws or like connecting elements are used to interconnect certain overlapping portions of the longitudinal edges. Such screws or like connectors are obviously disposed at given spaced apart intervals along the overlapping longitudinal edges of adjacent panels and accordingly, there is a tendency, during extremely highwind conditions or when an object strikes one or more of the panels for separation between the seams to occur. Damage is therefore more prevalent when utilizing these prior art storm shutter panels, especially when such panels are interconnected by the aforementioned screws or like connector elements due to the space separation of the seams when such panels are subjected to the aforementioned situations.

Further, the average house includes approximately 15 windows, two sliding doors, and two entrance doors, and accordingly will require approximately 90 panels of varying dimensions to be interconnected in collective arrays. In order to accomplish interconnection of such panels by the aforementioned screws or like connector elements, it would require approximately 360 screws to be driven or otherwise connected in the manner set forth above. Such application of such screws or like connector elements is not only extremely physical but also time-consuming. This is a serious problem when such panels have to be assembled in their protected, operative position in a short period of time, such as when an oncoming emergency and severe weather condition is eminent.

Accordingly, there is an obvious need in this area for a storm shutter assembly wherein the panels may be more efficiently and securely interconnected to one another to cover a given span or opening in a building and in such a manner which will effectively eliminate the need for auxiliary connectors such as screws or the like.

Other prior art examples of protective panels or the like include the U.S. patent to Dameton, U.S. Pat. No. 4,819,398, disclosing an improved roof panel apparatus and panel locking method. Dameron discloses substantially V-shaped panels specifically designed to be oriented in somewhat of a horizontal or horizontal plus angular orientation wherein the longitudinal edges of adjacent panels are interconnected to one another by a "manually snap-fitted" arrangement. Further, Dameron emphasizes that his specific structure forms a "mini-gutter" to provide for drainage of excess water from the panels primarily due to the fact that such panels are arranged in either a horizontal or somewhat slanted or angular orientation which has a more of a tendency to collect water during heavy rain conditions.

U.S. Pat. No. 4,182,080 to Naylot shows the use of panels as a sectionalized door closure for a barn door or the like wherein typical and well known connectors, such as screws, bolts, etc. are used to interconnect adjacently positioned ones of the panels comprising the sectionalized construction.

Other patents directed to the attachment of adjacently positioned segments for the production of some type of product not necessarily related to storm shutter panels includes the U.S. patent to House, U.S. Pat. No. 1,078,621, and the Italian Patent No. 690437.

The structures disclosed in the above-noted patents do not solve the problem specifically relating to the interconnection, by means of a closed seam, of storm shutter panels to form a storm shutter assembly in the manner set forth in greater detail hereinafter.

SUMMARY OF THE INVENTION

The present invention relates to a shutter assembly of the type comprising a plurality of panels which are interconnected in interlocking relation in an adjacent side-by-side array so as to overly and protectively cover an opening in a building such as but not limited to a window or door opening. Each of the panels are made from a high-strength, substantially lightweight material such as aluminum and also each of the panels may be ribbed so as to enhance the strength or structural integrity thereof.

An important feature of the present invention is the specific structural adaptation of each of a first and second, oppositely disposed longitudinal edge extending along the entire length of each of the plurality of panels forming the storm shutter assembly. More specifically, each of the longitudinal edges of each panel are configured and dimensioned to form a channel. Further, each channel is defined by a base and a spaced apart, substantially parallel outwardly extending flange. The orientation of the oppositely disposed longitudinal edges and disposition of each of the channels defining these opposite longitudinal edges is such that any one of the channels along a longitudinal edge is designed to receive and thereby interlock, in mating engagement with a correspondingly positioned flange formed on a next adjacent panel. Each of the channels have an elongated open side such that the elongated flange of the next adjacent panel may easily be received and passed therethrough into interlocking, and somewhat overlapping relation to the components forming the channel of the next adjacent panel.

As will be explained in even greater detail hereinafter, a first of the aforementioned longitudinal edges is structurally adapted such that the open side of the channel is formed somewhat on an inner surface of a given panel and the open side of such a channel faces inwardly towards a central longitudinal axis of the panel. The channel defining the opposite or second longitudinal edge of the given panel is formed somewhat on the outer surface of the panel such that the open side, extending along the length of the channel, faces inwardly towards a central longitudinal axis. By virtue of this construction, the flange formed on a correspondingly positioned longitudinal of a next adjacent panel will pass through the open side and into the channel of the next adjacent panel in a somewhat overlapping relation. By virtue of this specific disposition, configuration, and dimension of interlocking channels and flanges on the adjacent panels, a closed seam is formed along an entire common length of each of the connected panels. Such closed seam is not only resistant to separation along the entire length of the interconnecting and correspondingly positioned longitudinal edges of the adjacent panels but is also resistant to the passage or seepage of water therethrough during high wind, rain, or storm conditions.

This interlocking connection, defining the aforementioned closed seam, further and more importantly eliminate the need for any type of supplementary connectors such as screws or the like, in the prior art, to fixedly interconnect the overlapping longitudinal edges of prior art panels.

Such correspondingly positioned, interlocking longitudinal edges of adjacent panels is also resistant to separation when one or more of the panels are hit by some type of flying object because of high wind conditions.

Further, the interlocking, longitudinal edges of adjacent panels are readily disconnected from one another merely by removing one flange from a first panel from the elongated channel of the next adjacent panel as will be apparent when more fully described hereinafter.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
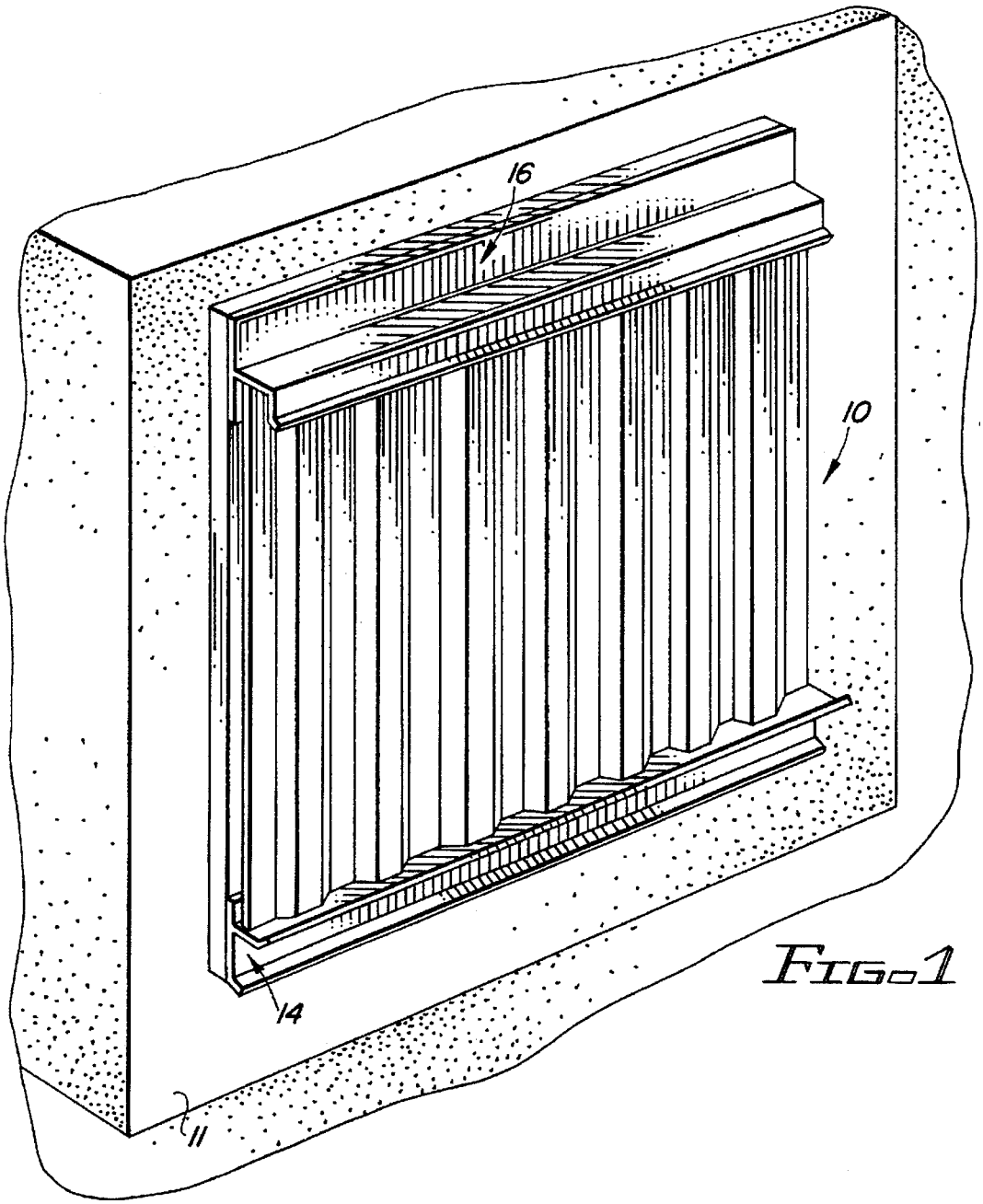
FIG. 1 is a perspective view of an assembled storm shutter assembly of the present invention in covering, protective relation to a door or window opening of a building in use with an upper tracking member which surrounds oppositely disposed ends of the assembled panels.

As shown in the accompanying drawings, the present invention is directed towards a storm shutter assembly generally indicated as 10 in FIG. 1 and shown therein in what may be considered an operative position. Such operative position is the assembly 10 comprising a plurality of panels interconnected along correspondingly positioned longitudinal edges and collectively arranged in a vertical array in overlying, protective and covering relation to a door, window, or like opening on a building 11. The plurality of panels 12 and 13, shown in detail in FIG. 2, may be mounted in or between a lower track 14 and an upper track 16 wherein such tracks are designed to substantially hold or at least partially surround the oppositely disposed ends of the plurality of panels.

Figure 2:
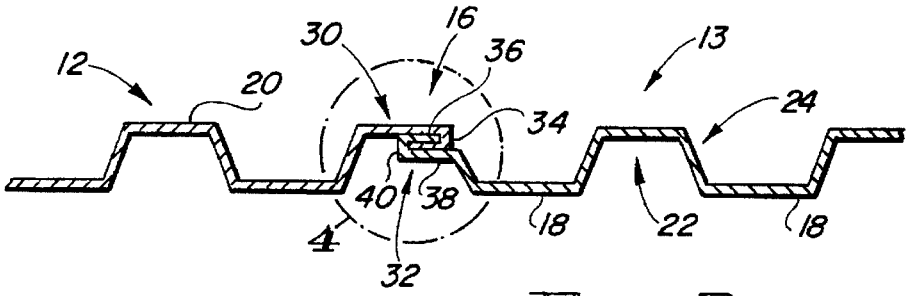
FIG. 2 is an end view of a plurality of panels comprising the subject shutter assembly in interlocking engagement with one another.

With regard to FIG. 2, the assembly 10 may comprise the aforementioned plurality of panels generally indicated as 12 and 13. Any number of panels may be so connected and arranged in the operative position or array as shown in FIG. 1 wherein the number of panels are dependent on the length or overall size of the door or window opening being covered.

Each of the panels 12 and 13 may include a plurality of ribs as at 18 and 20 extending outwardly, alternately from what may be considered an outer, exposed surface generally indicated as 22 and an inner surface generally indicated as 24.

An important feature of the present invention is the existence of two oppositely disposed longitudinal edges as at 30 and 32 formed for example on each of the panels but demonstrated more specifically with regard to adjacent panels 12 and 13 in FIG. 2. A first longitudinal edge as at 30 includes a channel 34 defined by a base 36 and a flange portion 38. Further, the innermost end of the flange 38 as at 40 is a free end and disposed in spaced relation to the base 36 so as to define an open end therebetween. This open end extends along the entire length of the channel 34 and provides access to the channel 34. It should be noted that the channel 34, the base 36, and the flange 38 extends along the entire length of the various panels 12 and 13. A connecting segment as at 42 serves to interconnect the corresponding ends of the base 36 and the flange 38 to one another in fixed engagement such that the spacing between the flange 38 and the base 36 is maintained. This spacing is such that the flange 38 may be considered disposed in somewhat parallel relation to the base 36 as when in the position shown in FIG. 2. The second or opposite longitudinal edge as at 32 of each panel includes the same basic structural features as the base 36, the flange 38, and the channel 34. Also, each of the channels includes the open end defined by the free end of the flange 38 being spaced from the base 36.

The first of the two, oppositely disposed longitudinal edges is such that it faces somewhat the outer surface 22 of each panel and further wherein the open end of the first channel as at 30 faces inwardly towards an imaginary, elongated longitudinal center of each of the panels. To the contrary, the channel 34 of the second longitudinal edge 32 faces inwardly towards an inner surface 24 of each of the panels and also faces inwardly towards the imaginary longitudinal center of each of the panels. This arrangement, disposition, and overall equivalent configuration allows for an interlocking of adjacently positioned horizontal edges of adjacent panels such as 12 and 13.

Figure 3:
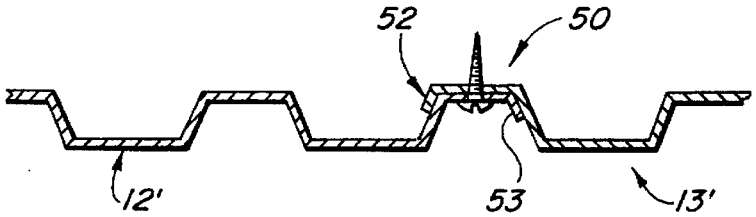
FIG. 3 (PRIOR ART)
FIG. 3 is an end view of connected panels representing the prior art.
Figure 6:
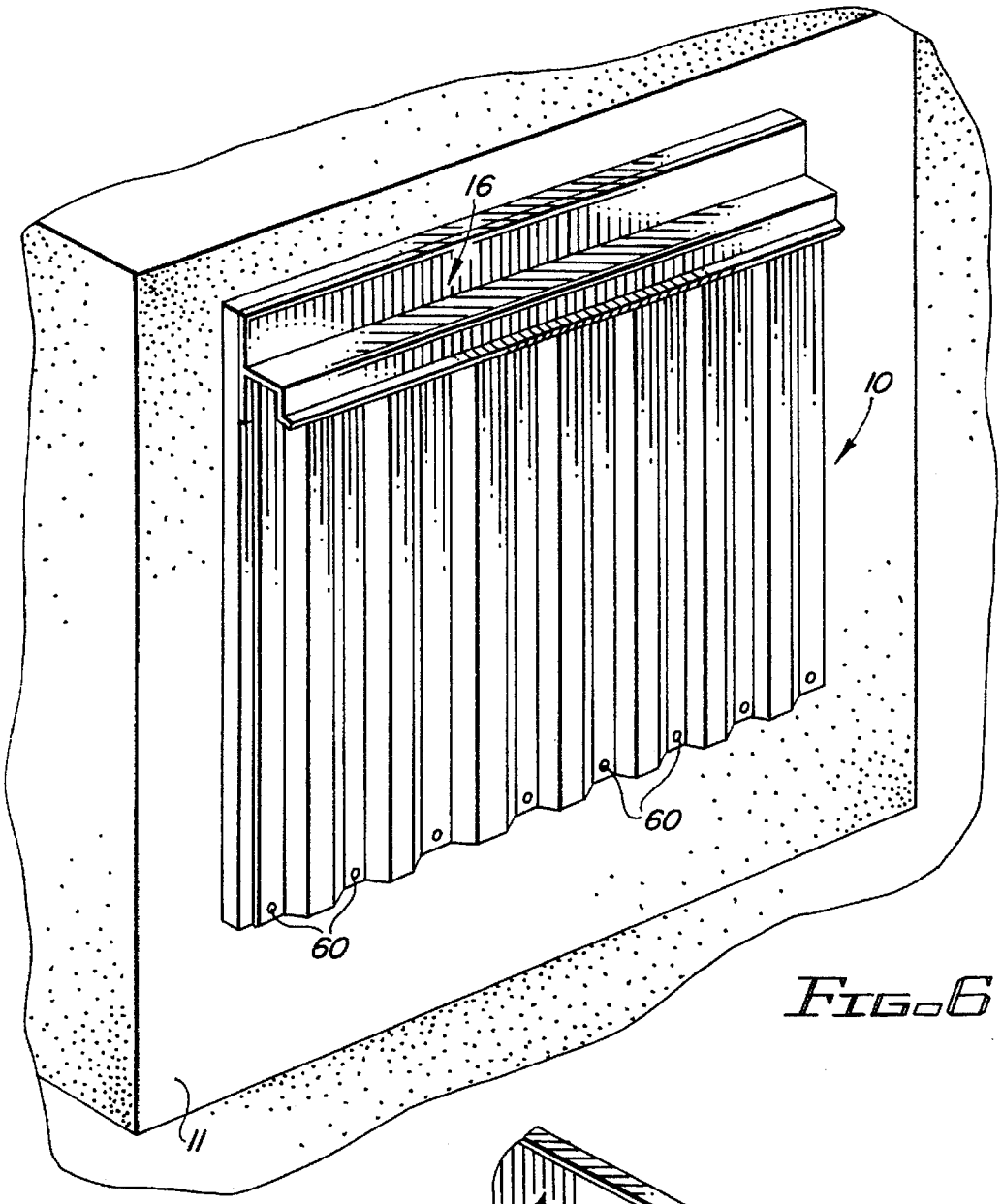
FIG. 6 is a perspective view of an alternative embodiment of the assembled storm shutter assembly of the present invention in covering relation to a door or window opening.
Figure 4:
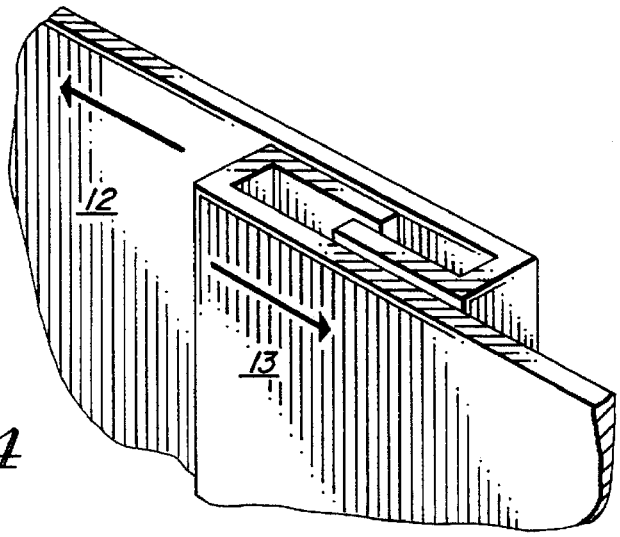
FIG. 4 is an isolated, close up illustration of an interconnection between two storm panels.

More specifically, the interlocking engagement of correspondingly positioned longitudinal edges of immediately or next adjacent panels 12 and 13 occurs when the flange of panel 12 fits within the channel of panel 13 along the entire common length of the panels 12 and 13. The inter engagement thereby defines a closed seam along the entire length which substantially eliminates the needs for any type of supplementary connectors as at 50 shown in the prior art of FIG. 3 being required to interconnect overlapping zones as at 52 and 53 of adjacently positioned panels 12' and 13'. Such connectors 50 were disposed in spaced apart relation to one another along the length of the overlapping portions of the correspondingly positioned longitudinal edges. Accordingly, the prior art lent itself to leaks or openings would occur under high wind conditions or when an object, travelling at high speed due to wind conditions, actually contacted or engaged the assembled panels, whether one or more of the panels such as shown in the prior art drawings of FIG. 3 at reference numerals 12' and 13'. Leakage and damage to the interior of a building or to the door or window access opening would be the result.

Further, the present invention may also include a plurality of supplementary connectors or bolts, such as fastener elements 60 disposed through one of the ribs of each of the panels, and secured to the tracks 14 or 16 and/or directly to the wall of the building itself. These bolts provide additional reinforcement if necessary and secure the panels to the tracks 14 and 16.

Figure 5:
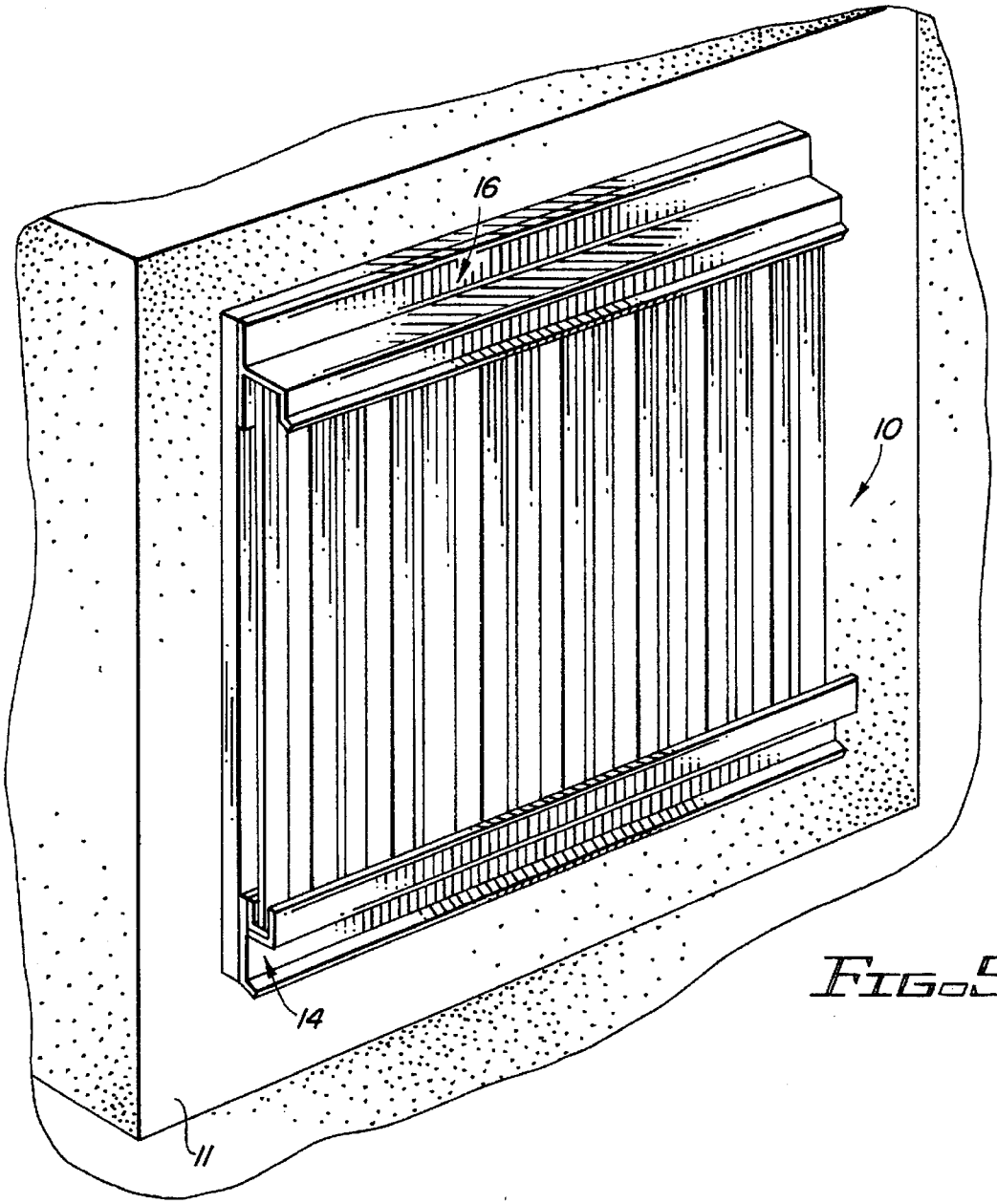
FIG. 5 is a perspective view of a preffered embodiment of the assembled storm shutter assembly of the present invention in covering, protective relation to a door or window opening of a building in use with an upper tracking member which surrounds oppositely disposed ends of the assembled panels.

Nevertheless, the present invention is preferably mounted, as illustrated in FIG. 5, between an upper, generally C-shaped header track 16' and a generally C-shaped base track 14' which secure the panels 12 and 13 in place without requiring any screws or bolts to be passed through the panels 12 and 13 themselves, and without requiring any clips or pins to be used. Also, the base track can be a single piece or two L-shaped members secured to one another so as to facilitate mounting. Still, however, the panels 12 and 13 of the present invention are structured to be able to be side mounted into the tracks, or lifted into at least one single piece C-shaped upper track 16'. Because of the specific structure and configuration of the interlocking edges 30 and 32 of the adjacent panels 12 and 13, the panels can be securely interlocked without retiring one of the panels to be disposed at an angle relative to the first panel that is greater than will be permitted by a width of the tracks. In particular, the panels 12 and 13 slide into interlocking position with one another, requiring only minor maneuvering which is well within the range of motion permitted by the tracks. Also, upon a outward pressure being exerted on the positioned and interlocked panels, the secure grip between the panels is increased.

The assembly of the present invention eliminates the need to secure a number of screws or tracks in place, a consideration which can be critical in circumstances where time is short. For example, if a hurricane changes course to suddenly effect an area, if a users house has many windows to protect, if a user has many structures to protect, or if an individual is alone, the elimination of the time consuming steps of securing the individual panels with screws, bolts or pins to a track, as is conventionally known, can be of great significance.

Additionally, it is preferred that the panels of the present invention be formed of extruded aluminum rather than the conventional steel rolled form. Specifically, aluminum formation eliminates the rounded corners and permits a full, sharp corner to be formed, the full corner providing substantially increased strength to impact and in fact functioning to lower the weight of the panels.

Now that the invention has been described,

What is claimed is:

1. A storm shutter assembly for forming a protective covering across an opening in a building and the like, said assembly comprising:

a) a plurality of panels formed of a high-strength material, each of said panels including an elongate configuration and having a first generally horizontal edge, a second generally horizontal edge, a first longitudinal edge and a second, oppositely disposed longitudinal edge, an outer surface and inner surface;

b) a track adapted to be secured to the building and extending along the opening to be covered, said track defining a channel with an opening;

c) said plurality of panels adaptable for covering the building opening with one of said horizontal edges of said panels being inserted through said opening and into said channel of said track;

d) each of said longitudinal edges of each said panel structured and disposed to interlock with a correspondingly positioned longitudinal edge of a next adjacently positioned one of said plurality of panels; and e) said interlocking longitudinal edges defining a closed seam between and extending along an entire common length of the adjacent panels, and being sized to permit interlocking assembly of said panels when said horizontal edges are retained within said channel of said track.

2. A storm shutter assembly for forming a protective covering across an opening in a building and the like, said assembly comprising:

a) a plurality of panels formed of a high-strength material, each of said panels including an elongate configuration and having an upper edge, a lower edge, a first, longitudinal edge and a second, oppositely disposed longitudinal edge, an outer surface and inner surface;

b) an upper track adapted to be secured to the building above and adapted to extend long the opening to be covered, said upper track defining a channel with a downwardly disposed opening;

c) said plurality of panels adaptable for being covering the building opening with said upper edges of said panels being inserted through said downwardly disposed opening and into said channel of said upper track;

d) each of said longitudinal edges of each said panel structured and disposed to interlock with a correspondingly positioned longitudinal edge of a next adjacently positioned one of said plurality of panels; and e) said interlocking longitudinal edges defining a closed seam between and extending along an entire common length of the adjacent panels, and being sized to permit interlocking assembly of said panels when said upper panel edges are retained within said channel of said upper track.

3. A storm shutter assembly as in claim 2 further comprising means for securely holding said assembly in place across the building opening.

4. A storm shutter assembly as in claim 3 wherein said holding means comprise a plurality of fastener elements.

5. A storm shutter assembly as in claim 3 wherein said holding means comprise a lower track member secured to the building beneath and extending along the opening to be covered.

* * * * *